US005561995A

United States Patent [19]

Copping et al.

[11] Patent Number: 5,561,995

[45] Date of Patent: Oct. 8, 1996

[54] DOOR FASTENER

[75] Inventors: Stuart F. Copping, Chandlers Ford; Adrian Q. Lindley, Grantham, both of Great Britain

[73] Assignee: Malcoe Precision Fabrications Ltd., England

[21] Appl. No.: 200,253

[22] Filed: Feb. 23, 1994

[30] Foreign Application Priority Data

Mar. 2, 1993 [GB] United Kingdom ..... 9304212

[51] Int. Cl.[6] ..... E05B 63/14

[52] U.S. Cl. ..... 70/120; 70/102; 70/114; 70/116; 292/37; 292/65; 292/111

[58] Field of Search ..... 70/120, 107, 102, 70/106, 109–111, 113–116, 118–123, 130, 131, 134–137, 139, 141, 142, DIG. 26, DIG. 34, 63; 292/34–39, 63–66, 69, 109, 111, 113, 115, DIG. 43, 57, 60, 31

[56] References Cited

U.S. PATENT DOCUMENTS

| | | | |
|---|---|---|---|
| 1,294,949 | 2/1919 | Roberts | 70/120 |
| 2,820,995 | 1/1958 | Schlueter | 292/111 X |
| 2,896,989 | 7/1959 | Ehret | 292/111 X |
| 2,991,106 | 7/1961 | Claud-Mantle | 292/65 |
| 3,094,346 | 6/1963 | Baker, Jr. | 292/65 X |
| 3,975,934 | 8/1976 | Babai et al. | 70/120 |
| 4,021,064 | 5/1977 | Kruzan et al. | 292/65 X |
| 4,060,267 | 11/1977 | Monfardini | 292/DIG. 57 X |
| 4,095,827 | 6/1978 | Stavenau | 292/111 X |
| 4,432,573 | 2/1984 | Goldman | 292/37 |
| 4,626,007 | 12/1986 | Larson | 292/65 |
| 4,665,727 | 5/1987 | Uyeda | 70/277 X |
| 5,020,345 | 6/1991 | Gartner et al. | 70/277 |
| 5,213,381 | 5/1993 | Anderson | 292/111 |

FOREIGN PATENT DOCUMENTS

| | | | |
|---|---|---|---|
| 56212 | 5/1939 | Denmark | 292/65 |
| 123236 | of 1900 | Germany | 292/115 |
| 592483 | 1/1934 | Germany | 70/120 |
| 433568 | 8/1935 | United Kingdom | 292/65 |
| 669066 | 3/1952 | United Kingdom . | |
| 2185059 | 7/1987 | United Kingdom . | |
| 2272016 | 7/1995 | United Kingdom . | |

*Primary Examiner*—Steven N. Meyers
*Assistant Examiner*—Suzanne L. Dino
*Attorney, Agent, or Firm*—Kenyon & Kenyon

[57] ABSTRACT

A door locking mechanism 8 is described having an espagnolette mechanism interconnecting longitudinally movable bolts 12 at the periphery of a door 4. The bolts 12 have individual deadlocking mechanisms that serve to prevent their own movement and via the espagnolette mechanism the movement of all the other parts of the door locking mechanism 8. The bolts 12 are deadlocked by the action of a bush 26 fitted within a slot 24 in the bolts 12 and applying a transverse force thereto. The deadlocking of the bolts 12 serves to compress the door 4 shut.

13 Claims, 7 Drawing Sheets

DOOR FASTENER

BACKGROUND OF THE INVENTION

1. Field of the Invention

This invention relates to door fasteners and door locking mechanisms. More particularly, this invention relates to door locking mechanisms incorporating an espagnolette mechanism.

2. Description of the Prior Art

Many different sorts of door locking mechanisms are known. One such sort of known door locking mechanism is the espagnolette mechanism, in which moving a single handle or lock serves to actuate a plurality of fasteners at the periphery of the door. Such door locking mechanisms are typically used in French windows and the like where they hold the door firmly shut using a plurality of fastening points.

A requirement of door locking mechanisms is that they should be secure against unauthorised opening. These requirements are particularly important in situations where the door and door locking mechanism are accessible to the public. One such situation arises in the case of streetside cabinets used to hold electronic equipment, such as telephone, cable television and cellular radio apparatus, in outdoor locations. The equipment that is housed in such streetside cabinets can have a high financial value, be physically delicate and be required to maintain a high degree of reliability. In these circumstances, it is particularly important that the streetside cabinets should have door locking mechanisms that are highly secure so as to prevent vandalism and tampering with the equipment inside.

SUMMARY OF THE INVENTION

The present invention provides a door fastener comprising a fastener body, a threaded stud extending from said fastener body, a bush having a threaded bore engaging said threaded stud, and a bolt coupled to said fastener body by said bush so as to be longitudinally movable between an extended position and a withdrawn position relative to said fastener body. When said bolt is in said extended position, said threaded stud is rotatable using a key applied to said door fastener to tighten said bush against said bolt, thereby applying a force transverse to said bolt to hold said bolt deadlocked.

An object of the door fasteners of the present invention is to provide additional security as compared to prior art fasteners. The primary function of the door fasteners is to prevent the opening of the door. Additional advantages can be achieved in preferred embodiments in which, when deadlocked, said door fasteners serve to compress said door shut against a door frame. The compression of the door against the door frame provides additional resistance against forcing and serves to make the door more environmentally protective by producing a better environmental seal around the periphery of the door.

As mentioned above, the basic function of the door fasteners is to latch the door against opening. This function and the security of the door mechanism is enhanced in preferred embodiments in which, when deadlocked, said door fasteners hook into engagement with said door frame.

The action of the bush upon the bolt serves to deadlock the bolt, but the threaded stud for actuating the bush can itself be deadlocked by providing an arrangement in which said threaded stud is coupled to a rotatable lock cylinder mounted in said fastener body, said lock cylinder being engaged and driven by said key and having means for preventing rotation thereof when said door fastener is deadlocked.

The friction of the bolt tightened against the fastener body may be sufficient to deadlock the bolt, with or without the action of the bolt hooking into the door frame, but the deadlocking operation is made more secure when complementary formations on said fastener body and said bolt move into engagement as said bush pulls said bolt against said fastener body thereby preventing longitudinal movement of said bolt.

The movement of the bolt in relation to the fastener body should desirably occur in a controlled manner. To this end, in preferred embodiments, said bolt and said fastener body are shaped to provide a pivot point therebetween about which said bolt pivots as said bush applies said transverse force to said bolt.

An important practical consideration in addition to the strength and security of the locking action is the reliability with which it unlocks. To this end, preferred embodiments provide a spring disposed between said bolt and said fastener body so as to urge said bolt away from said fastener body and out of deadlock when said bush is not applying said transverse force.

In preferred embodiments, the bush can also engage both faces of the bolt so as to be able to positively drive the bolt out of its deadlocked position.

The door fasteners of the present invention are particularly useful within a door locking mechanism comprising an espagnolette mechanism for driving each of a plurality of said door fasteners, at different edges of a door, between the withdrawn and said extended positions. At least one of the door fasteners has an individual deadlocking mechanism for deadlocking the door fastener in the extended position thereby preventing further movement of the door fastener, the espagnolette mechanism, and the other of said plurality of door fasteners.

This door locking mechanism provides additional security because the provision of an individual deadlocking mechanism associated with the door fastener at the edge of the door means that this deadlocking mechanism must be defeated as well as all the other locking mechanisms within the system if the door is to be picked or forced open. The coupling together of the various parts of the door locking mechanism by the espagnolette mechanism has the effect that the security measures at different parts of the door locking mechanism are mutually self-supporting.

In addition to the deadlocking mechanisms associated with the door fasteners at the periphery of the door, security is further enhanced when said espagnolette mechanism has a central deadlock for preventing movement of said espagnolette mechanism to drive said fasteners.

One form of attack on a door locking mechanism of the type discussed above is that an attempt could be made to force the door fasteners into the withdrawn position. A preferred feature which assists in resisting such action is that in which said espagnolette mechanism comprises a crank and a plurality of rods interconnected between ends of said crank and said door fasteners for driving said fasteners, said crank being movable through an over centre position to a closed stop position as said door fasteners move to said extended position, whereby applying force to said door fasteners to return said door fasteners to said withdrawn position urges said crank away from said over centre position and towards said closed stop position.

While the above-described door locking mechanism is of general utility when high security is an important consideration, it is particularly useful in the field of electronic apparatus enclosures.

The above, and other objects, features and advantages of this invention will be apparent from the following detailed description of illustrative embodiments which is to be read in connection with the accompanying drawings.

DESCRIPTION OF THE PREFERRED EMBODIMENTS

Figure 1:
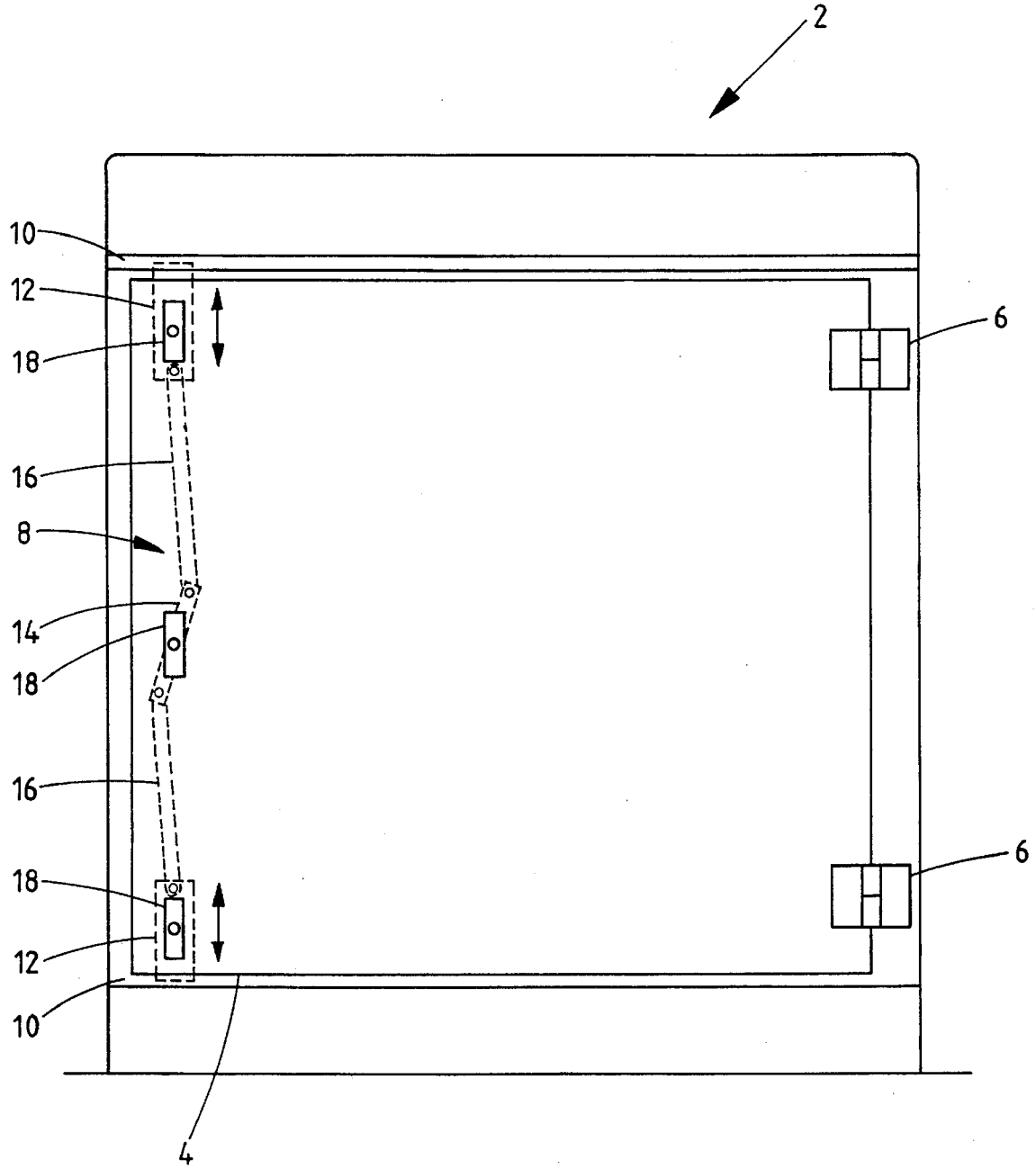
FIG. 1 illustrates an electronic apparatus enclosure having a door locking mechanism.

FIG. 1 shows an electronic apparatus enclosure 2 of the type used to house equipment such as telephone equipment in outdoor locations, The enclosure 2 has a door 4 attached via hinges 6 and a door locking mechanism 8 to a door frame 10, The door locking mechanism 8 has longitudinally movable bolts 12 at the top and bottom of the door 4, These longitudinal bolts are interconnected by an espagnolette mechanism comprising a crank 14 and connecting rods 16. The door locking mechanism 8 is shown in the door latched position in which the longitudinal bolts 12 are engaging the door frame 10. Escutcheons 18 associated with each of the longitudinal bolts 12 forming the door fasteners and the crank of the espagnolette mechanism provide access for a key that can be used to deadlock each of these items.

Figure 2:
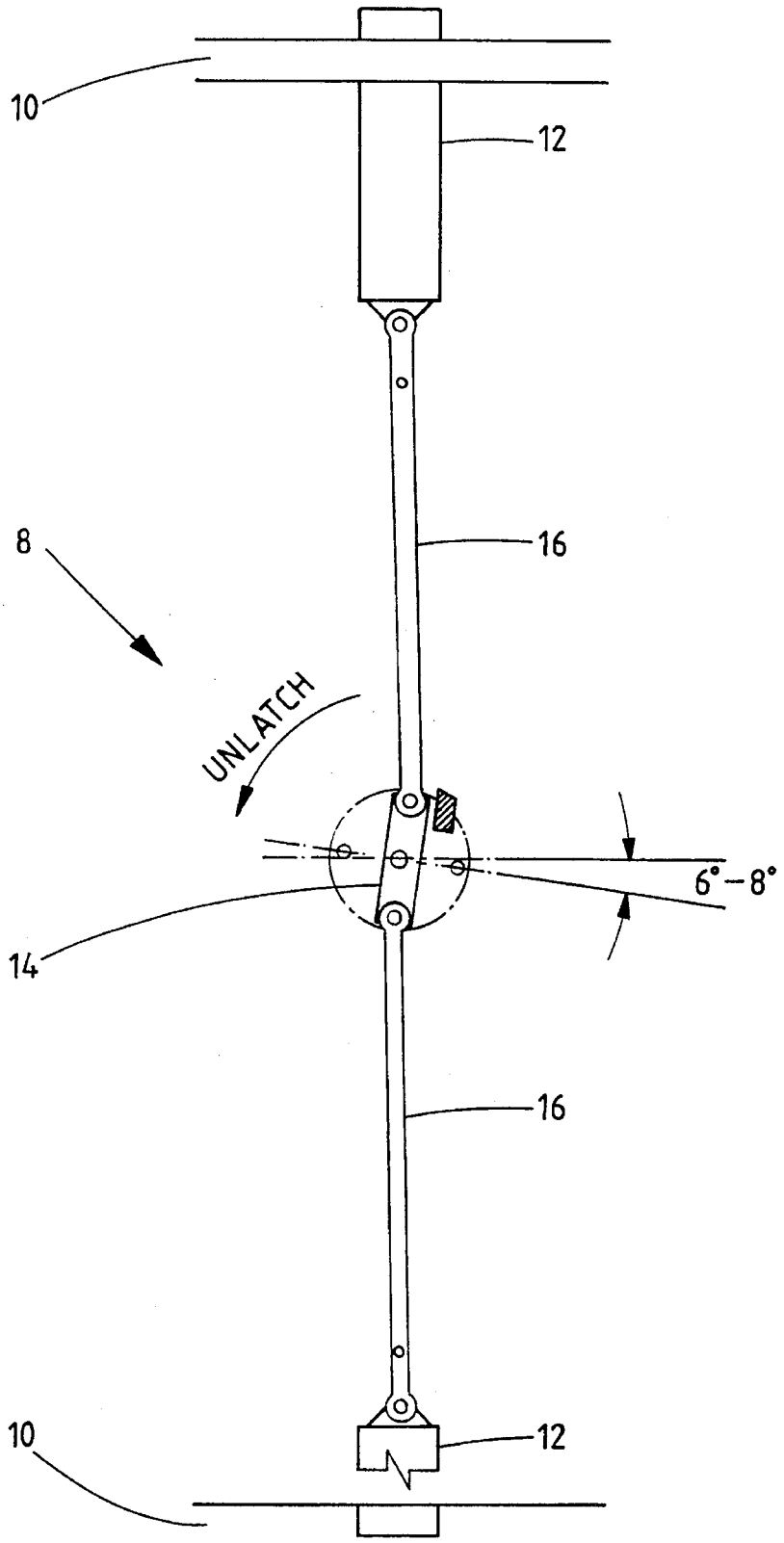
FIG. 2 illustrates that espagnolette mechanism of FIG. 1 in more detail.

FIG. 2 illustrates the door locking mechanism 8 in more detail. The bolts 12 are shown in their extended positions engaging the door frame 10. The length of the crank 14 can be varied to provide the throw to the bolts 12 sufficient for the desired purpose. In the door latched position at which the crank 14 is deadlocked, the crank 14 is rotated beyond the vertical by approximately 6°–8°. This is a closed stop position. The position in which the crank 14 is vertical can be considered an over centre position. Rotation of the crank 14 beyond this over centre position into the closed stop position where it is deadlocked has the effect that, if an attempt is made to force the lock mechanism 8 by driving the bolts 12 out of the door frame 10, then this will be resisted by the espagnolette mechanism since it will tend to drive the espagnolette mechanism in the opposite sense to that actually required to unlatch the door 4.

Figure 3:
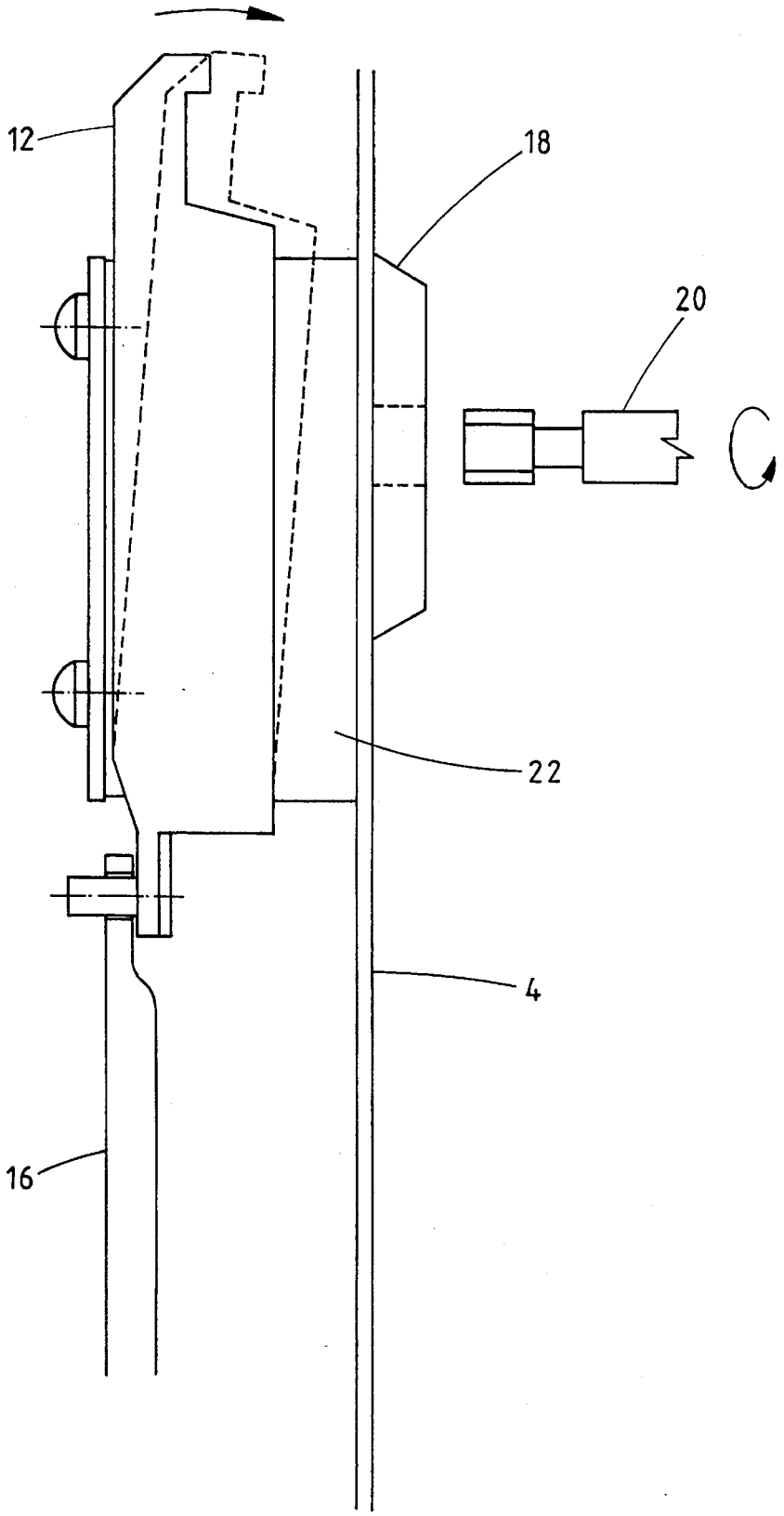
FIG. 3 shows a side view of a fastener for use at the peripheral edge of a door.

FIG. 3 shows the fastener at the peripheral edge of the door 4. A key 20 inserted through the escutcheon 18 can be rotated to wind the bolt 12 towards the door 4. The bolt 12 pivots about a point of contact between the bolt 12 and a fastener body 22. In use, the bolt 12 is moved outwardly into engagement with the door frame 10 by the action of the connecting rod 16 and then the key 20 is to wind the bolt 12 towards the door 4 and into a deadlocked position in which it cannot be longitudinally moved. The movement of the bolt 12 also serves to compress the door 4 shut. Once deadlocked in this way movement of the connecting rod 16 is also prevented.

Since the connecting rod 16 for this fastener is rigidly coupled by the crank 14 and the other connecting rod 16 to the other fastener, movement of the other fastener is also prevented. It will be appreciated, that the other fastener also has this deadlocking arrangement and so the mutual backing-up of security also works in the opposite sense. In order to defeat the locking mechanism 8, both of the deadlocks at the bolts 12 need to be defeated. In addition to this, a central deadlocking mechanism is provided at the crank 14 which must also be defeated if the door is to be opened.

Figure 4A:
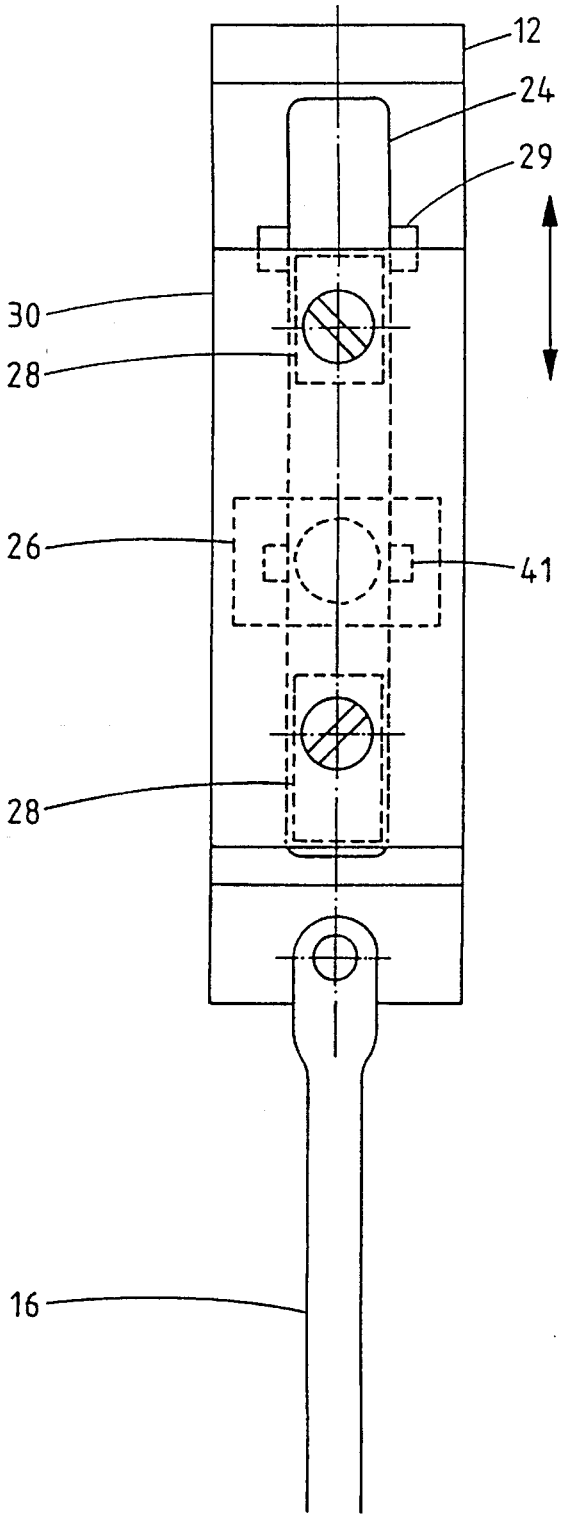
FIG. 4 shows the action of the longitudinally movable bolt.
Figure 4B:
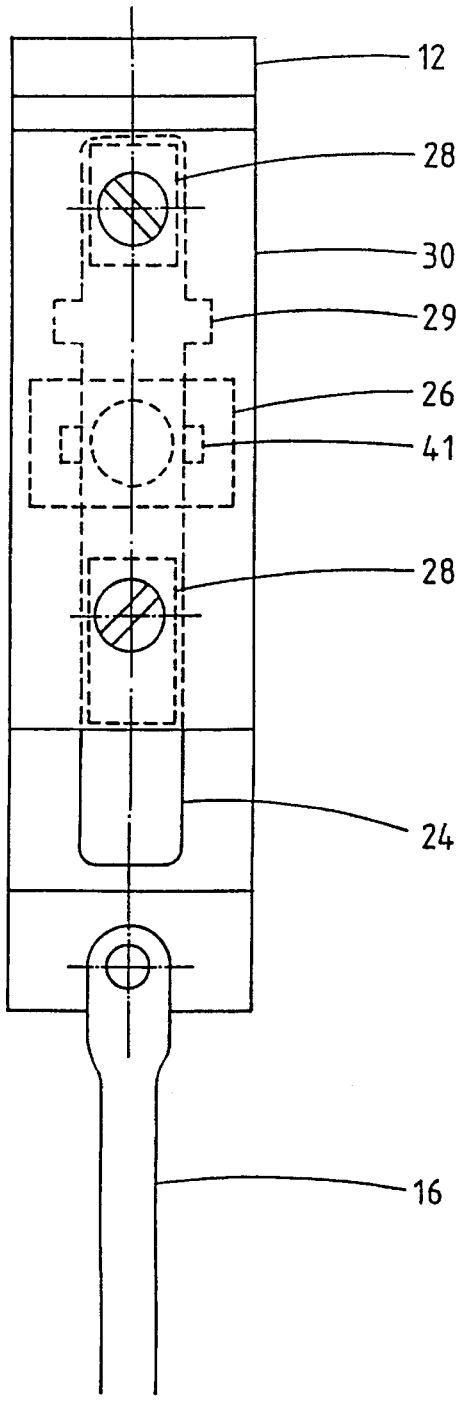
Figure 5A:
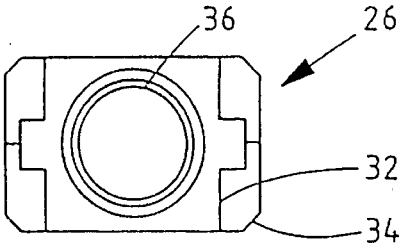
FIG. 5 shows various views of a bush that acts as part of the deadlocking mechanism of the fastener.
Figure 5B:
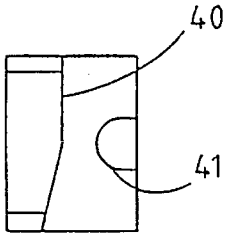
Figure 5C:
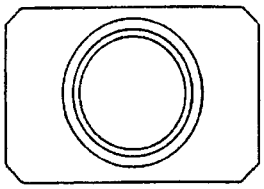
Figure 5D:
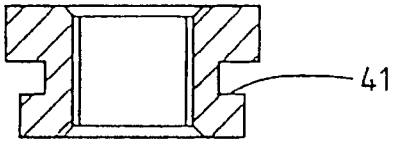

FIG. 4 shows a rear view of the fastener of FIG. 3. The bolt 12 has a slot 24 therein. A bush 26 is fitted within this slot 24. Support blocks 28 extend from the fastener body 22 and are a sliding fit within the slot 24. A backing plate 30 is fixed to the support blocks 28. The bolt 12 is thus slidably mounted on the fastener body 22, the fastener body 22 being fixed through the door 4 to the escutcheon 18.

As illustrated in FIG. 5, the bush 26 has a narrow portion 32 that fits within the slot 24 and a wide portion 34 that is wider than the slot 24. The bush 26 also has a threaded bore 36 therein. The backing plate 30 covers the wide portion 34 of the bush 26 and holds the bush 26 in position within the slot 24 as a fail safe. The bush 26 also has lugs 41 extending from the narrow portion 32. When the bush is fitted in place within the slot 24, the lugs 41 engage the opposite face of the bolt 12 to that engaged by the wide portion 34. The slot 24 has cut out 29 in its edges through which the lugs 41 are passed during assembly.

The left-hand side of FIG. 4 shows the bolt 12 in its extended position in which the door is latched and the right-hand side of FIG. 4 shows the bolt 12 in its withdrawn position in which the door 4 is unlatched.

Figure 6:
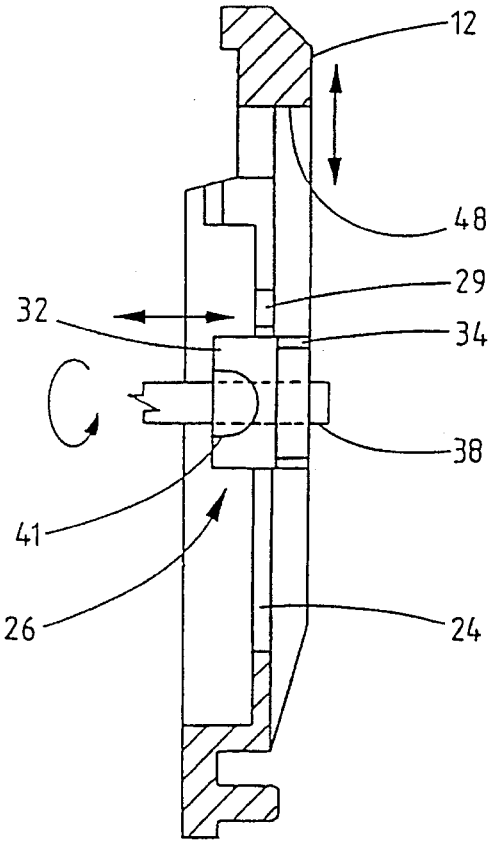
FIG. 6 schematically illustrates the operation of the bush of FIG. 5 in deadlocking the fastener.

FIG. 6 shows a cross-section through the bolt 12 and the relationship with the bush 26. The narrow portion 32 of the bush 26 slides within the slot 24 allowing longitudinal movement of the bolt 12. The wide portion 34 of the bush 26 fits behind the bolt 12. A threaded stud 38 fitted within the threaded bore 36 of the bush 26 may be rotated to move the bush 26 relative to the threaded stud 38. As the bush 26 moves towards the door 4 it exerts a transverse force on the bolt 12 via its shoulder portions 40 (as can be seen in the side view of FIG. 5, the shoulder 40 is sloped at one end so as to take account of the pivoting action of the bolt 12). The lugs 41 engage the opposite face of the bolt 12 and, as the threaded stud 38 is rotated in the opposite sense, the lugs 41 apply a transverse force to the bolt 12 to move it away from its deadlock position.

Figure 7:
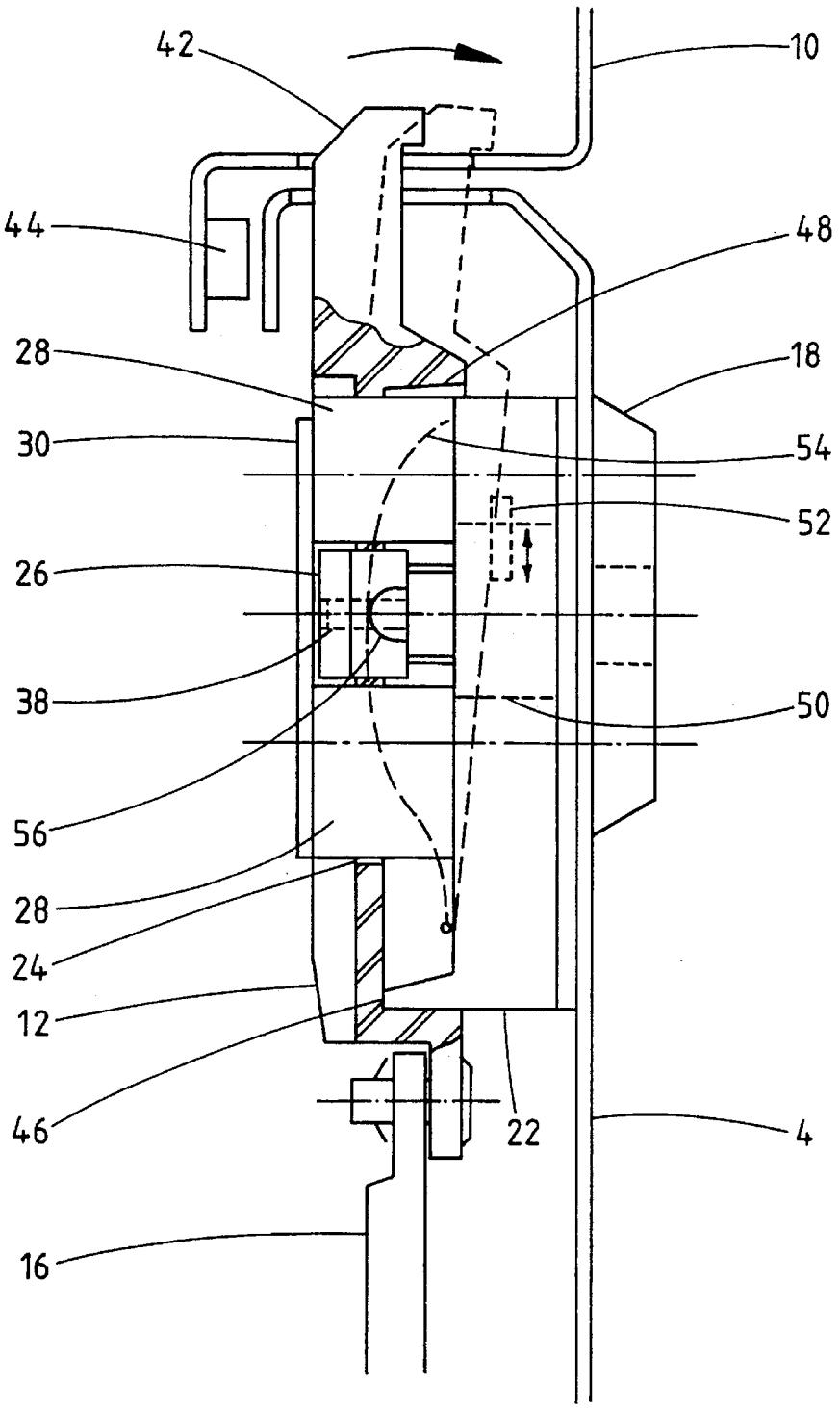
FIG. 7 is a partially cut away view of the fastener and its operation in respect of the door and a door frame.

FIG. 7 is a partial cross-sectional view of the fastener. The outward end 42 of the bolt 12 is shaped such that when the fastener is deadlocked, the outer end 42 of the bolt 12 hooks into engagement with the door frame 10. As the fastener is deadlocked and the bolt 12 is moved towards the door 4, the door 4 is compressed shut and is forced into abutment with an environmental seal 44. This provides improved environmental resistance.

The relative shapes of the bolt 12 and the fastener body 22 can be seen to provide a pivot point 46 about which the bolt 12 pivots when in the door latching position as it is deadlocked. It can also be seen how the bolt 12 and fastener body 22 have complementary formations such that a shoulder 48 on the bolt 12 moves over the end of the fastener body 22 as the fastener is deadlocked and thus prevents longitudinal movement of the bolt 12.

A steel leaf spring 54 is disposed between the fastener body 22 and the bolt 12 to move these items apart as the deadlocking mechanism is released. The lugs 41 also serve to positively drive the fastener body 22 and the bolt 12 apart as the threaded stud 38 is rotated.

Figure 8:
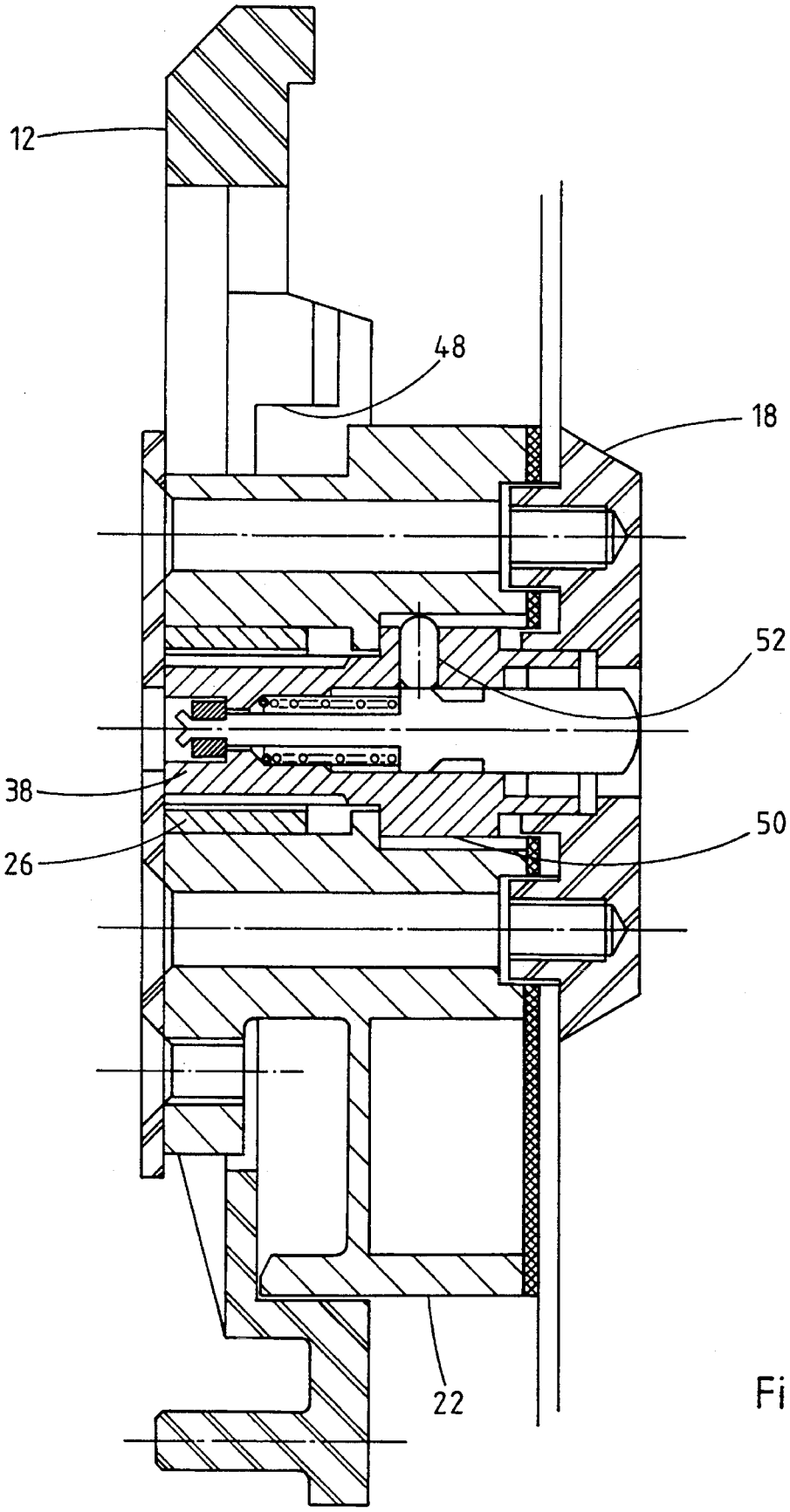
FIG. 8 is a cross-sectional view through a slightly modified version of the fastener.

As can be seen more clearly in FIG. 8, a rotatable lock cylinder 50 is disposed within the fastener body 22 and has the threaded stud 38 extending therefrom that engages with and drives the bush 26. The lock cylinder 50 has a radial pin 52 associated therewith that prevents rotation of the lock cylinder 50 unless the correct key 20 is inserted. The action of the lock cylinder 50 can take a number of forms. One such form is described in British Published Patent Application GB-A-2272016. The lock of this prior application may also be used as a central deadlock of the crank 14.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

We claim:

1. A door locking mechanism comprising:

an espagnolette mechanism for driving each of a plurality of door fasteners, at least one door fastener including:

(i) a fastener body;

(ii) a threaded stud extending from said fastener body;

(iii) a bush having a threaded bore engaging said threaded stud; and (iv) a bolt coupled to said fastener body by said bush so as to be longitudinally movable between an extended position and a withdrawn position relative to said fastener body;

(v) whereby, when said bolt is in said extended position, said threaded stud is rotatable relative to said bush using a key applied to said door fastener to tighten said bush against said bolt, such that said bush applies a force transverse to said bolt to hold said bolt deadlocked in said extended position, wherein the door fasteners are located at differing edges of a door, the espagnolette mechanism driving each door fastener between said withdrawn position and said extended position, at least one of said door fasteners having an individual deadlocking mechanism for deadlocking said door fastener in said extended position thereby preventing further movement of said door fastener, said espagnolette mechanism and the other of said door fasteners.

2. A door locking mechanism as claimed in claim 1, wherein said espagnolette mechanism has a central deadlock for preventing movement of said espagnolette mechanism to drive said door fasteners.

3. A door locking mechanism as claimed in claim 1, wherein said espagnolette mechanism comprises a crank and a plurality of rods interconnected between ends of said crank and said door fasteners for driving said door fasteners, said crank being movable through an over centre position to a closed stop position as said door fasteners move to said extended position, whereby applying force to said door fasteners to return said fasteners to said withdrawn position urges said crank away from said over centre position and towards said closed stop position.

4. An electronic apparatus enclosure comprising:

a door and a door locking mechanism including:

an espagnolette mechanism for driving each of a plurality of door fasteners, at least one door fastener including:

(i) a fastener body;

(ii) a threaded stud extending from said fastener body;

(iii) a bush having a threaded bore engaging said threaded stud; and (iv) a bolt coupled to said fastener body by said bush so as to be longitudinally movable between an extended position and a withdrawn position relative to said fastener body;

(v) whereby, when said bolt is in said extended position, said threaded stud is rotatable relative to said bush using a key applied to said door fastener to tighten said bush against said bolt, such that said bush applies a force transverse to said bolt to hold said bolt deadlocked in said extended position, wherein the door fasteners are located at different edges of the door, the espagnolette mechanism driving each door fastener between said withdrawn position and said extended position, at least one of said door fasteners having an individual deadlocking mechanism for deadlocking said door fastener in said extended position thereby preventing further movement of said door fastener, said espagnolette mechanism and the other of said door fasteners.

5. A door fastener comprising:

(i) a fastener body;

(ii) a threaded stud extending from said fastener body;

(iii) a bush having a threaded bore engaging said threaded stud; and (iv) a bolt coupled to said fastener body by said bush so as to be longitudinally movable between an extended position and a withdrawn position relative to said fastener body;

(v) whereby, when said bolt is in said extended position, said threaded stud is rotatable relative to said bush using a key applied to said door fastener to tighten said bush against said bolt, such that said bush applies a force transverse to said bolt to hold said bolt deadlocked in said extended position.

6. A door fastener as claimed in claim 5, wherein said bush slides within a slot in said bolt.

7. A door fastener as claimed in claim 5, wherein said bush engages both faces of said bolt so as to also serve to apply a force transverse to said bolt to drive said bolt away from deadlock.

8. A door fastener as claimed in claim 5, wherein said threaded stud is coupled to a rotatable lock cylinder mounted in said fastener body, said lock cylinder being engaged and driven by said key and having means for preventing rotation thereof when said fastener is deadlocked.

9. A door fastener as claimed in claim 5, wherein complementary formations on said fastener body and said bolt move into engagement as said bush pulls said bolt against said fastener body thereby preventing longitudinal movement of said bolt.

10. A door fastener as claimed in claim 5, wherein said bolt and said fastener body are shaped to provide a pivot point therebetween about which said bolt pivots as said bush tightens against said bolt.

11. A door fastener as claimed in claim 5, comprising a spring disposed between said bolt and said fastener body so as to urge said bolt away from said fastener body and out of deadlock when said bush is not tightened against said bolt.

12. A door fastener as claimed in claim 5, wherein, in use, said fastener serves to compress a door shut against a door frame.

13. A door fastener as claimed in claim 5, wherein, when deadlocked, said bolt hooks into engagement with said door frame.

* * * * *